US010485719B2

(12) United States Patent
Murphy

(10) Patent No.: US 10,485,719 B2
(45) Date of Patent: Nov. 26, 2019

(54) POWER-ASSISTED RECLINING LIFT CHAIR WITH SPLIT SEAT

(71) Applicant: Ultra-Mek, Inc., Denton, NC (US)

(72) Inventor: Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 181 days.

(21) Appl. No.: 15/801,825

(22) Filed: Nov. 2, 2017

(65) Prior Publication Data

US 2018/0161223 A1 Jun. 14, 2018

Related U.S. Application Data

(60) Provisional application No. 62/432,727, filed on Dec. 12, 2016.

(51) Int. Cl.
*A61G 5/14* (2006.01)
*A47C 7/50* (2006.01)
(Continued)

(52) U.S. Cl.
CPC ..... *A61G 5/14* (2013.01); *A47C 1/024* (2013.01); *A47C 1/0242* (2013.01);
(Continued)

(58) Field of Classification Search
CPC ..... A61G 5/14; A61G 5/128; A47C 1/024; A47C 1/0242; A47C 1/0355; A47C 7/506
(Continued)

(56) References Cited

U.S. PATENT DOCUMENTS 3,087,757 A 4/1963 Fidel
3,337,267 A 8/1967 Rogers, Jr.
(Continued)

FOREIGN PATENT DOCUMENTS

JP 2012-016992 A 1/2012

OTHER PUBLICATIONS

Notification of Transmittal of the International Search Report and the Written Opinion of the International Searching Authority, or the Declaration corresponding to International Application No. PCT/US2017/059454 dated Feb. 26, 2018.
(Continued)

*Primary Examiner* — Mark R Wendell
(74) *Attorney, Agent, or Firm* — Myers Bigel, P.A.

(57) ABSTRACT

A seating unit includes: a base; a frame including opposed arms; a backrest; a seat, the seat including a front portion and a rear portion; a footrest; a lift mechanism attached to the base, the frame and the seat; a lift drive unit attached to the lift mechanism; a reclining mechanism attached to the seat and the backrest; a recline drive unit attached to the reclining mechanism; a footrest mechanism attached to the base and the footrest; and a footrest drive unit attached to the footrest mechanism. The lift mechanism controls the movement of the frame, seat and backrest between an upright position and a lift position. The reclining mechanism is configured to control the movement of the backrest and seat between the upright position and a reclined position. The footrest mechanism is configured to control the movement of the footrest between the upright position and an extended position.

21 Claims, 12 Drawing Sheets

(51) Int. Cl.
*A47C 1/024* (2006.01)
*A61G 5/12* (2006.01)
*A47C 1/034* (2006.01)

(52) U.S. Cl.
CPC ..... *A47C 1/0345* (2013.01); *A47C 7/506* (2013.01); *A61G 5/128* (2016.11)

(58) Field of Classification Search
USPC ..... 297/339
See application file for complete search history.

(56) References Cited

U.S. PATENT DOCUMENTS 3,522,969 A 8/1970 Re
3,869,169 A 3/1975 Johnson et al.
3,941,417 A 3/1976 Re
4,072,342 A 2/1978 Johnson et al.
4,185,869 A 1/1980 Rogers, Jr.
4,212,494 A 7/1980 Dabney
4,270,796 A 9/1981 Preston
4,307,912 A 12/1981 Watt
4,332,417 A 6/1982 Mizelle
4,350,387 A 9/1982 Rogers, Jr.
4,506,925 A 3/1985 Crum
4,662,673 A 5/1987 Crum
4,815,788 A 3/1989 May
4,878,710 A 11/1989 Tacker
4,904,019 A 2/1990 May
4,915,444 A 4/1990 Rogers, Jr.
4,989,914 A 2/1991 Pine
4,993,777 A 2/1991 LaPointe
5,013,084 A 5/1991 May
5,072,988 A 12/1991 Plunk
5,087,094 A 2/1992 Rogers, Jr.
5,088,789 A 2/1992 LaPointe et al.
5,090,768 A 2/1992 Re et al.
5,110,179 A 5/1992 Rogers
5,169,208 A 12/1992 Re et al.
5,312,153 A * 5/1994 Lin ..... A47C 1/0345 297/68
5,354,116 A 10/1994 May et al.
5,360,255 A 11/1994 Cook
5,368,366 A 11/1994 Mizelle
5,374,101 A 12/1994 Wiecek
5,480,213 A 1/1996 Sproule
5,556,158 A 9/1996 Wiecek
5,588,710 A 12/1996 Wiecek
5,651,580 A 7/1997 LaPointe et al.
5,730,494 A 3/1998 LaPointe et al.
5,772,278 A 6/1998 Kowalski
5,775,775 A 7/1998 Hoffman
5,800,010 A 9/1998 May
5,823,614 A 10/1998 Johnson et al.
5,971,475 A * 10/1999 Lawson ..... A47C 1/0355 297/68
5,975,627 A 11/1999 LaPointe et al.
5,992,930 A 11/1999 LaPointe et al.
6,000,758 A * 12/1999 Schaffner ..... A47C 1/0345 297/180.12
6,089,660 A 7/2000 Sproule
6,142,558 A 11/2000 May
6,540,291 B2 4/2003 Hoffman et al.
6,729,686 B2 5/2004 May
6,793,279 B2 9/2004 Hoffman et al.
7,357,450 B2 4/2008 Rogers
7,396,074 B2 7/2008 Wiecek
7,445,278 B2 11/2008 Wiecek
7,445,279 B2 11/2008 Crum
7,540,565 B2 6/2009 Lipford
7,594,694 B2 9/2009 Wiecek
7,641,277 B2 1/2010 Lawson et al.
7,669,921 B2 3/2010 Hoffman et al.
7,669,922 B2 3/2010 Murphy et al.
7,673,933 B2 3/2010 Lawson
7,762,625 B2 7/2010 Hoffman et al.
7,766,421 B2 8/2010 Lawson
7,997,644 B2 8/2011 Hoffman et al.
8,016,348 B2 9/2011 Hoffman et al.
8,113,574 B2 2/2012 Hoffman et al.
8,123,288 B2 2/2012 Murphy et al.
8,297,693 B2 10/2012 Hoffman et al.
8,360,515 B2 1/2013 Crum
8,398,165 B2 3/2013 Lawson
8,419,122 B2 4/2013 Lawson et al.
8,459,733 B2 6/2013 Hoffman et al.
8,783,764 B2 7/2014 Murphy
9,022,473 B2 5/2015 Crum
9,326,608 B1 * 5/2016 Hoy ..... A47C 1/03211
2001/0035668 A1 * 11/2001 Gaffney ..... A47C 1/0345 297/85 M
2002/0149238 A1 10/2002 Hoffman
2003/0057743 A1 3/2003 May
2006/0290174 A1 12/2006 Hoffman et al.
2007/0126267 A1 6/2007 Hoffman et al.
2008/0001455 A1 * 1/2008 Gong ..... A61G 5/14 297/344.12
2009/0278395 A1 11/2009 Pollard et al.
2010/0072805 A1 * 3/2010 Qiu ..... A47C 1/0355 297/85 R
2010/0264702 A1 10/2010 Hoffman et al.
2010/0283297 A1 11/2010 Crum
2011/0175426 A1 7/2011 Lawson
2011/0233972 A1 9/2011 Wiecek
2011/0291460 A1 12/2011 Murphy et al.
2011/0304193 A1 12/2011 Murphy et al.
2012/0049606 A1 3/2012 Lawson et al.
2012/0104827 A1 5/2012 Murphy et al.
2012/0112519 A1 5/2012 Murphy et al.
2012/0146364 A1 6/2012 Hoffman et al.
2012/0153704 A1 6/2012 Hoffman et al.
2012/0235449 A1 9/2012 Wiecek
2012/0299363 A1 11/2012 Crum
2013/0038095 A1 2/2013 Lawson et al.
2013/0200659 A1 8/2013 Hoffman et al.
2014/0327282 A1 11/2014 Crum
2014/0333099 A1 11/2014 Lu et al.
2015/0021959 A1 1/2015 Garland
2015/0282619 A1 * 10/2015 Lawson ..... A47C 1/0355 297/83
2015/0289655 A1 * 10/2015 Lawson ..... A47C 1/0342 297/75
2016/0088942 A1 3/2016 Murphy
2016/0332541 A1 * 11/2016 Bowen ..... B60N 2/995
2016/0346143 A1 12/2016 White et al.
2018/0094711 A1 * 4/2018 Lawson ..... F16H 25/20

OTHER PUBLICATIONS

Notification of Transmittal of the International Search Report and the Written Opinion of the International Searching Authority, or the Declaration corresponding to International Application No. PCT/US2017/060264 dated Feb. 14, 2018.
International Preliminary Report on Patentability corresponding to International Application No. PCT/US2017/059454 dated Jun. 27, 2019.

* cited by examiner

POWER-ASSISTED RECLINING LIFT CHAIR WITH SPLIT SEAT

RELATED APPLICATION

The present application claims priority from and the benefit of U.S. Provisional Patent Application No. 62/432,727, filed Dec. 12, 2016, the disclosure of which is hereby incorporated herein in its entirety.

FIELD OF THE INVENTION

The present invention is directed generally to lift chairs, and more particularly to lift chairs having reclining capability.

BACKGROUND OF THE INVENTION

Conventionally, power-assisted lift chairs typically include a motor-operated mechanism for aiding invalids and those persons requiring assistance in entering or exiting the chair. More particularly, motor-operated lift mechanisms are interconnected between a stationary base assembly and a moveable chair frame. An example of such a power-assisted chair is disclosed in U.S. Pat. No. 4,993,777 to LaPointe.

Some power-assisted chairs also include separate linkage mechanisms for permitting the seat occupant to selectively actuate an extensible leg rest assembly and/or produce reclining angular movement of a seat assembly between "upright" and "reclined" positions. However, many power-assisted chairs which provide such a multi-functional combination require the use of multiple motors for driving (i.e., pushing) the separate linkages which results in extremely large and expensive chair units yet still having limited reclining options. Moreover, such power assisted chairs typically incorporate a drive mechanism which employs both a power "drive" function (i.e., for extending the leg rest, lifting the chair, and/or reclining the chair) and a power "return" function for returning the chair to the normal seated position.

One power-assisted lift chair that employs a single actuator is disclosed in U.S. Pat. No. 5,730,494 to LaPointe et al. This chair employs a linear actuator with a carrier, wherein the carrier moves rearwardly relative to the base to lift the chair from its upright position. The carrier moves forwardly to move the chair from its upright position to its TV and fully reclined positions. Another lift chair employing a single actuator is discussed in U.S. Pat. No. 8,783,764 to Murphy.

Still another power-assist lift chair is discussed in U.S. Pat. No. 7,540,565 to Lipford, which employs a "split" seat. The front portion of the seat pivots to slope downwardly from back to front as the chair rises to the lift position. This motion can provide support surfaces for the occupant that eases rising from the chair.

Those skilled in this art will appreciate that additional chair designs with improved functionality may be desirable.

SUMMARY

As a first aspect, embodiments of the invention are directed to a seating unit, comprising: a base configured to rest on an underlying surface; a frame including opposed arms; a backrest; a seat, the seat including a front portion and a rear portion; a footrest; a lift mechanism pivotally attached to the base, the frame and the seat; a lift drive unit attached to the lift mechanism; a reclining mechanism pivotally attached to the seat and the backrest; a recline drive unit attached to the reclining mechanism; a footrest mechanism pivotally attached to the base and the footrest; and a footrest drive unit attached to the footrest mechanism. The lift mechanism is configured to control the movement of the frame, seat and backrest between an upright position, in which the backrest is generally upright, the front and rear portions of the seat are generally horizontal, the footrest is generally upright and positioned below the seat, and the backrest, seat and frame are at a first elevation, and a lift position, in which the backrest is generally upright, and, rear portion of the seat is generally horizontal, and the backrest, rear portion of the seat and frame are at a second elevation that is higher than the first elevation, and the front portion of the seat is generally vertically disposed. The reclining mechanism is configured to control the movement of the backrest and seat between the upright position and a reclined position, in which the backrest takes a shallower angle relative to horizontal than in the upright position. The footrest mechanism is configured to control the movement of the footrest between the upright position and an extended position, in which the footrest is generally horizontally disposed and positioned forwardly of the seat.

As a second aspect embodiments of the invention are directed to a seating unit comprising: a base configured to rest on an underlying surface; a frame including opposed arms; a backrest; a seat, the seat including a front portion and a rear portion; a footrest; a lift mechanism pivotally attached to the base, the frame and the seat; a lift drive unit attached to the lift mechanism; a reclining mechanism pivotally attached to the seat and the backrest; a recline drive unit attached to the reclining mechanism; a footrest mechanism pivotally attached to the base and the footrest; and a footrest drive unit attached to the footrest mechanism. The lift mechanism is configured to control the movement of the frame, seat and backrest between an upright position, in which the backrest is generally upright, the front and rear portions of the seat are generally horizontal, the footrest is generally upright and positioned below the seat, and the backrest, seat and frame are at a first elevation, and a lift position, in which the backrest is generally upright, and rear portion of the seat is generally horizontal, and the backrest, rear portion of the seat and frame are at a second elevation that is higher than the first elevation, and the front portion of the seat is generally vertically disposed. The reclining mechanism is configured to control the movement of the backrest and seat between the upright position and a reclined position, in which the backrest takes a shallower angle relative to horizontal than in the upright position. The footrest mechanism is configured to control the movement of the footrest between the upright position and an extended position, in which the footrest is generally horizontally disposed and positioned forwardly of the seat. The footrest mechanism is decoupled from the lift mechanism such that operation of the lift mechanism does not move the footrest relative to the base. The footrest mechanism is decoupled from the reclining mechanism such that operation of the reclining mechanism does not move the footrest relative to the base.

As a third aspect, embodiments of the invention are directed to a seating unit comprising: a base configured to rest on an underlying surface; a frame including opposed arms; a backrest; a seat, the seat including a front portion and a rear portion; a footrest; a lift mechanism pivotally attached to the base, the frame and the seat; a lift drive unit attached to the lift mechanism; a reclining mechanism pivotally attached to the seat and the backrest; a recline drive unit attached to the reclining mechanism; a footrest mechanism pivotally attached to the base and the footrest; and a footrest drive unit attached to the footrest mechanism. The lift mechanism is configured to control the movement of the frame, seat and backrest between an upright position, in which the backrest is generally upright, the front and rear portions of the seat are generally horizontal, the footrest is generally upright and positioned below the seat, and the backrest, seat and frame are at a first elevation, and a lift position, in which the backrest is generally upright, and rear portion of the seat is generally horizontal, and the backrest, rear portion of the seat and frame are at a second elevation that is higher than the first elevation, and the front portion of the seat is generally vertically disposed. The reclining mechanism is configured to control the movement of the backrest and seat between the upright position and a reclined position, in which the backrest takes a shallower angle relative to horizontal than in the upright position. The footrest mechanism is configured to control the movement of the footrest between, the upright position and an extended position, in which the footrest is generally horizontally disposed and positioned forwardly of the seat. The lift mechanism is decoupled from the reclining mechanism, such that an angle between the backrest and the underlying surface does not substantially change during operation of the lift mechanism. The footrest mechanism is decoupled from the lift mechanism such that operation of the lift mechanism does not move the footrest relative to the base.

DETAILED DESCRIPTION

Figure 1:
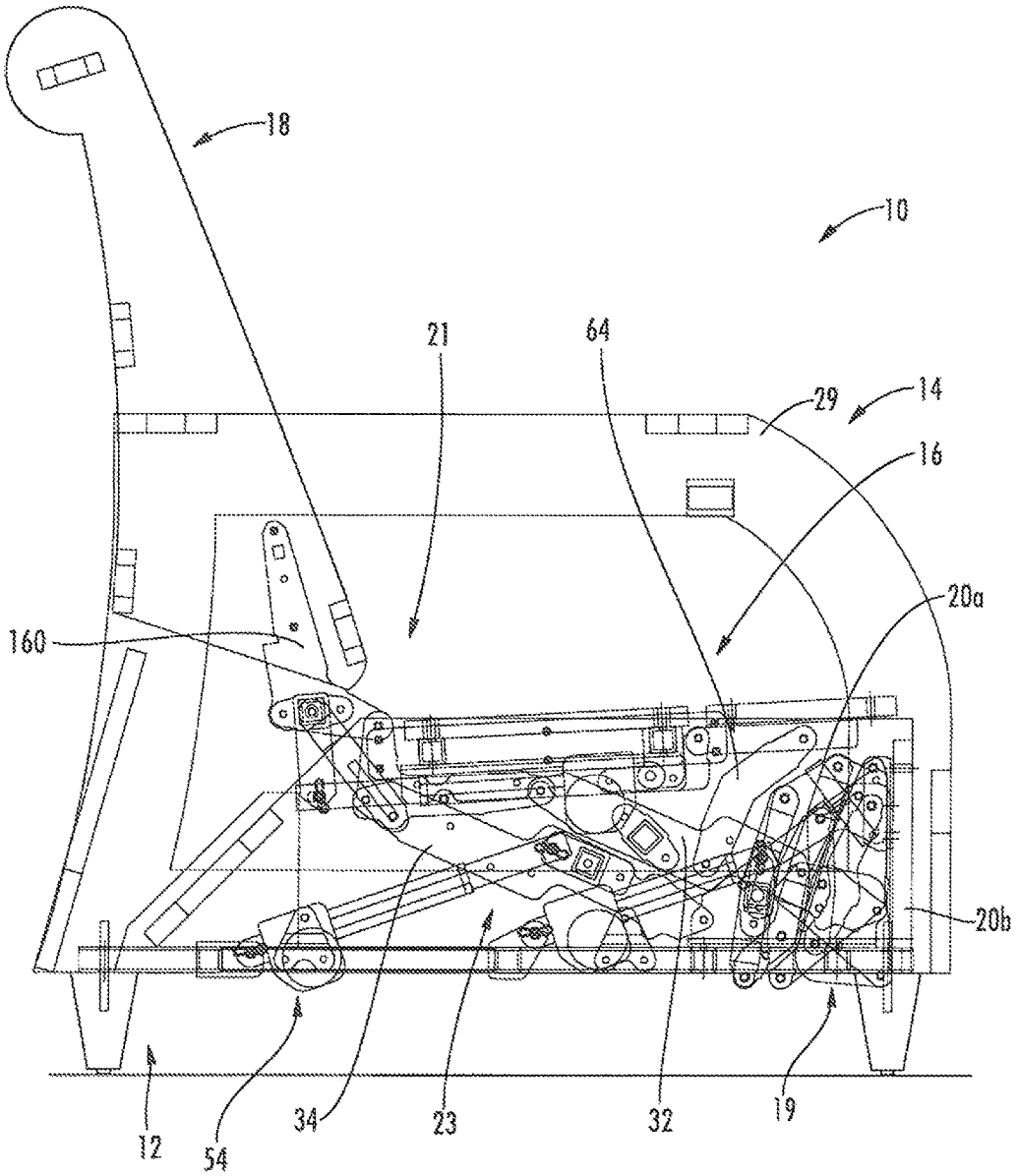
FIG. 1 is a side view of a reclining lift chair according to embodiments of the invention, with the chair shown in its upright position.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Where used, the terms "attached", "connected", "interconnected", "contacting", "coupled", "mounted" and the like can mean either direct or indirect attachment or contact between elements, unless stated otherwise.

In addition, some components of the seating units described herein (particularly mechanisms thereof) are illustrated, herein as a series of pivotally interconnected links or members. Those skilled in this art will appreciate that the pivots between links, or other components can take a variety of configurations, such as pivot pins, rivets, bolt and nut combinations, and the like, any of which may be suitable for use with the present invention. Also, the shapes and configurations of the links themselves may vary, as will be understood by those skilled in this art. Further, some links may be omitted entirely in some embodiments, and additional links may be included in some embodiments.

Referring now to, the drawings, a reclining lift chair, designated broadly at 10, is shown in FIGS. 1-4. The chair includes a base 12 that rests on an underlying surface, a frame 14, a seat 16, a backrest 18, and rear and front footrests 20*a*, 20*b*. These structures are interconnected with a pair of reclining mechanisms 21, a pair of footrest mechanisms 19, and a pair of lift mechanisms 23 (see FIG. 3). These components are discussed in greater detail below.

Figure 3:
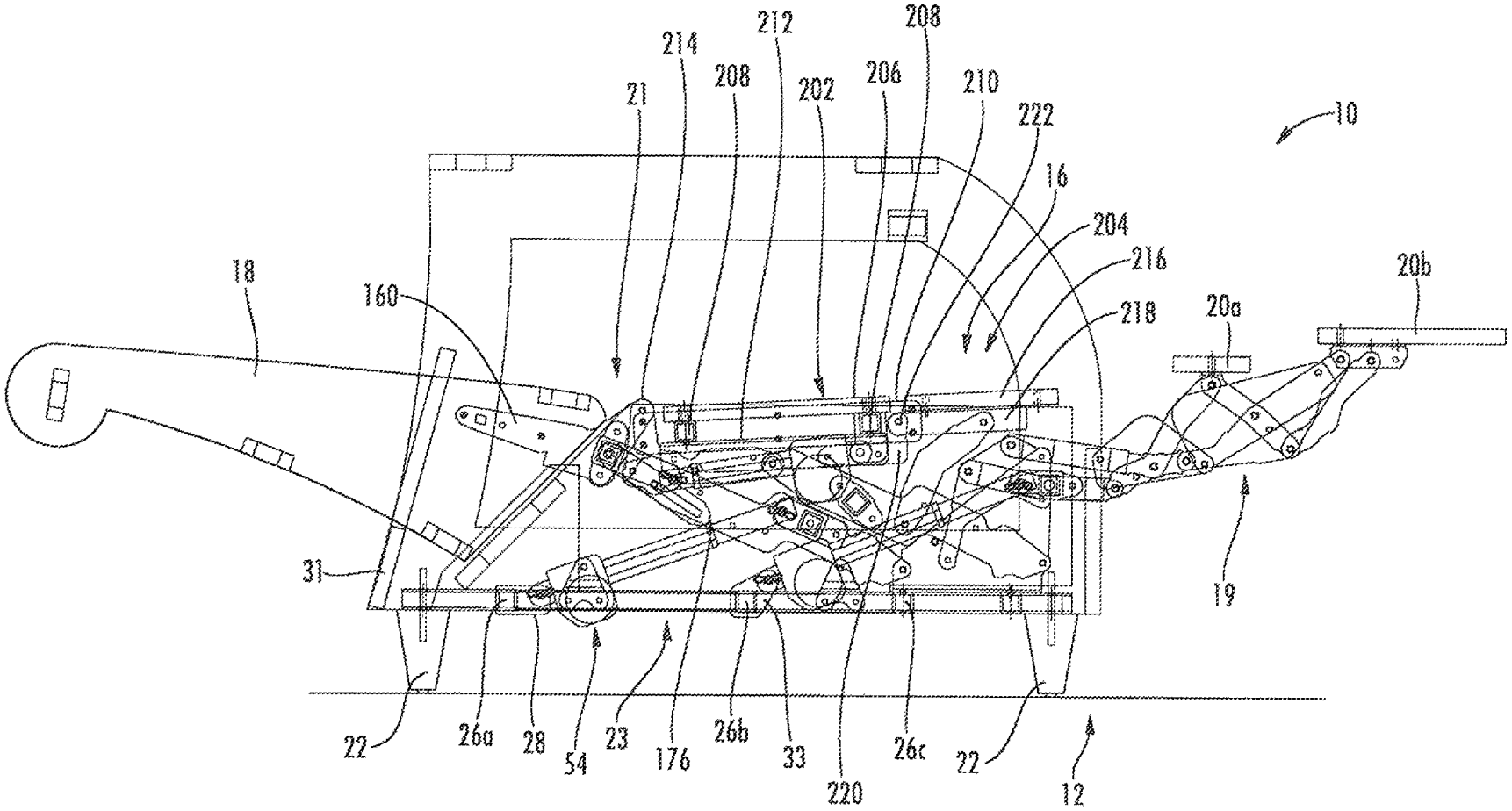
FIG. 3 is a side view of the chair of FIG. 1 shown with the backrest in the reclined position and the footrest in the extended position.
Figure 4:
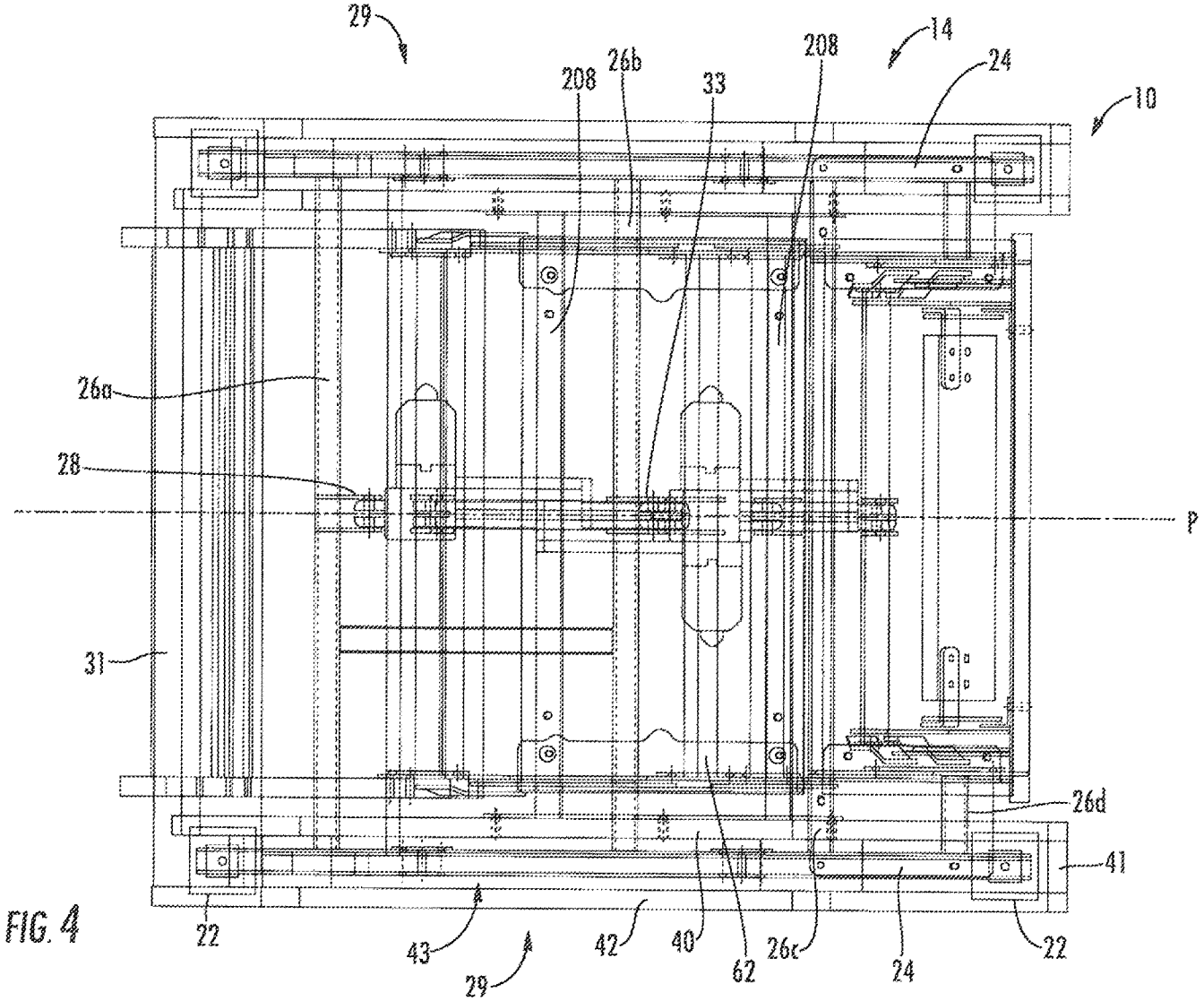
FIG. 4 is a top view of the chair of FIG. 1 in the upright position.

Referring now to FIGS. 3 and 4, the base 12 includes a pair of side rails 24 and three cross-members 26*a*, 26*b*, 26*c* that extend between the side rails 24. Two feet 22 are mounted to the underside of each side rail 24. A lift actuator mounting bracket 28 is mounted to the rearmost cross-member 26*a*, and a footrest mounting bracket 33 is mounted to the cross-member 25*b*. Covers 35 are mounted above the side rails 24 and are spanned by a cross-rail 35*a*.

Referring still to FIGS. 3 and 4, the frame 14 includes arms 29 and a rear panel 31 that spans the arms 29. Each arm 29 comprises an inner panel 40 and an outer panel 42 that are separated by spacers 41, thereby forming a cavity 43 within each arm 29.

Figure 2:
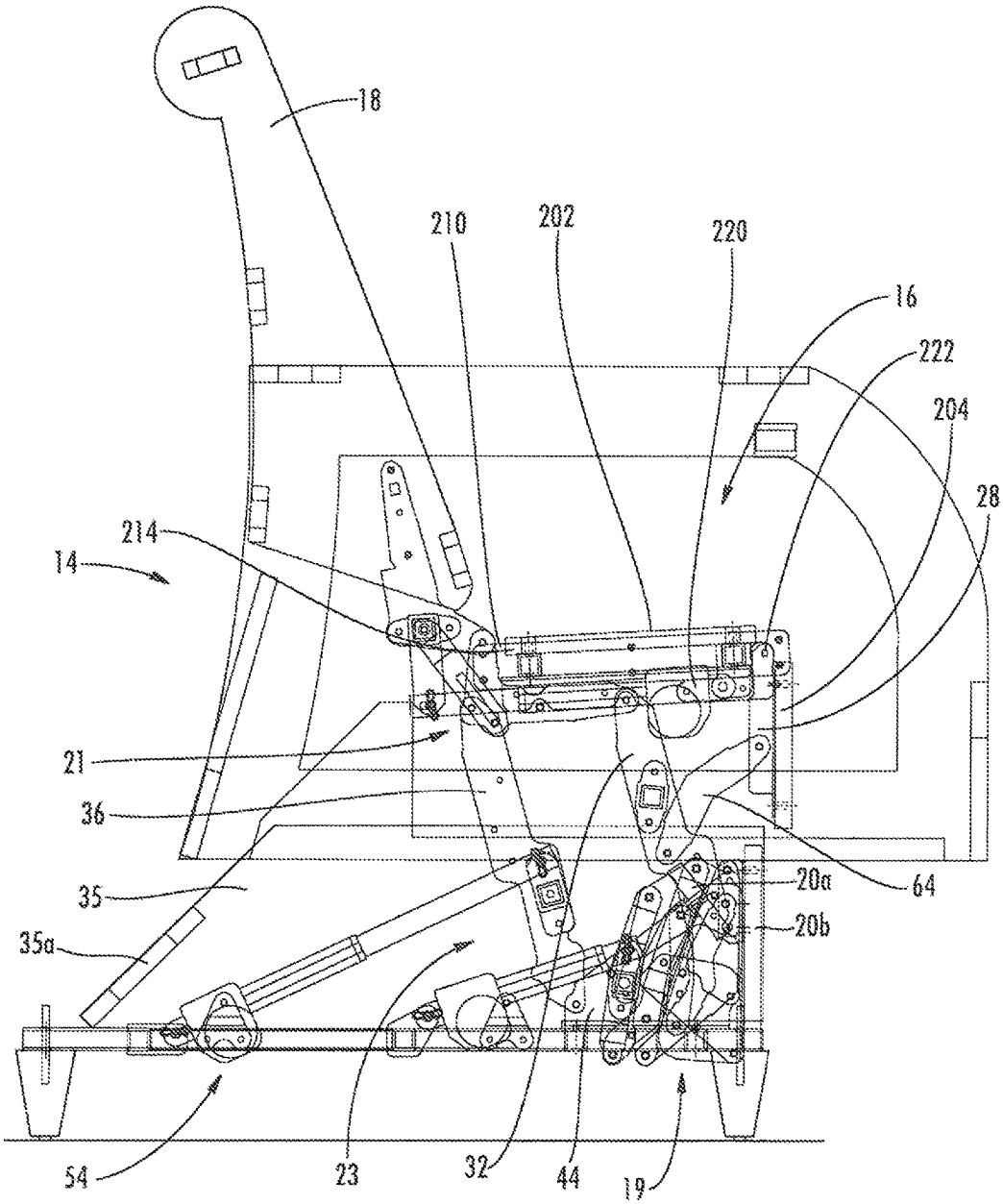
FIG. 2 is a side view of the chair of FIG. 1 shown in the lift position.

Referring to FIGS. 2, 3 and 4, the seat 16 is split into front and rear portions 202, 204. The rear portion 202 has a platform 206 that sits atop cross-members 208. The cross-members 208 are fixed to mounting panels 210 that are in turn fixed to the inner panels 40 of the arms 29. Angle brackets 212 are attached to the underside of the cross-members 208. A seat link 214 is fixed to each angle bracket 212. The front portion 204 of the seat 16 has a platform 216 that is mounted on angle brackets 218. The angle brackets 218 are pivotally attached to connecting brackets 220 at a pivot 222; the connecting brackets 220 are fixed to the front ends of the angle brackets 212 of the rear portion 202. Upholstery (not shown) overlies the platforms 206, 216.

The lift mechanisms 23 are configured to move the chair 10 between an upright position (shown in FIGS. 1, 4, 5 and 8), in which the backrest 18 is generally upright and defines a first backrest angle relative to horizontal, both portions 204, 204 of the seat 16 are generally horizontal, and the footrests 20*a*, 20*b* are retracted below the seat 16, and a lift position (FIGS. 2, 6 and 9), in which the frame 14 and the seat 16 are raised, with the rear portion 202 of the seat remaining generally horizontal and the front portion 204 of the seat 16 being generally vertical. For clarity, the lift mechanisms 23 will be described first with respect to the lift position (FIGS. 2, 6 and 9).

Also, each of the lift mechanisms 23 is a mirror image of the other lift mechanism 23 relative to a vertical plane P that extends from the front of the chair 10 to the rear centered between the arms 29 (see FIG. 4). In the interest of brevity, only one lift mechanism 23 will be described herein, with the understanding that the discussion is equally applicable to its mirror image lift mechanism 23.

Figure 6:
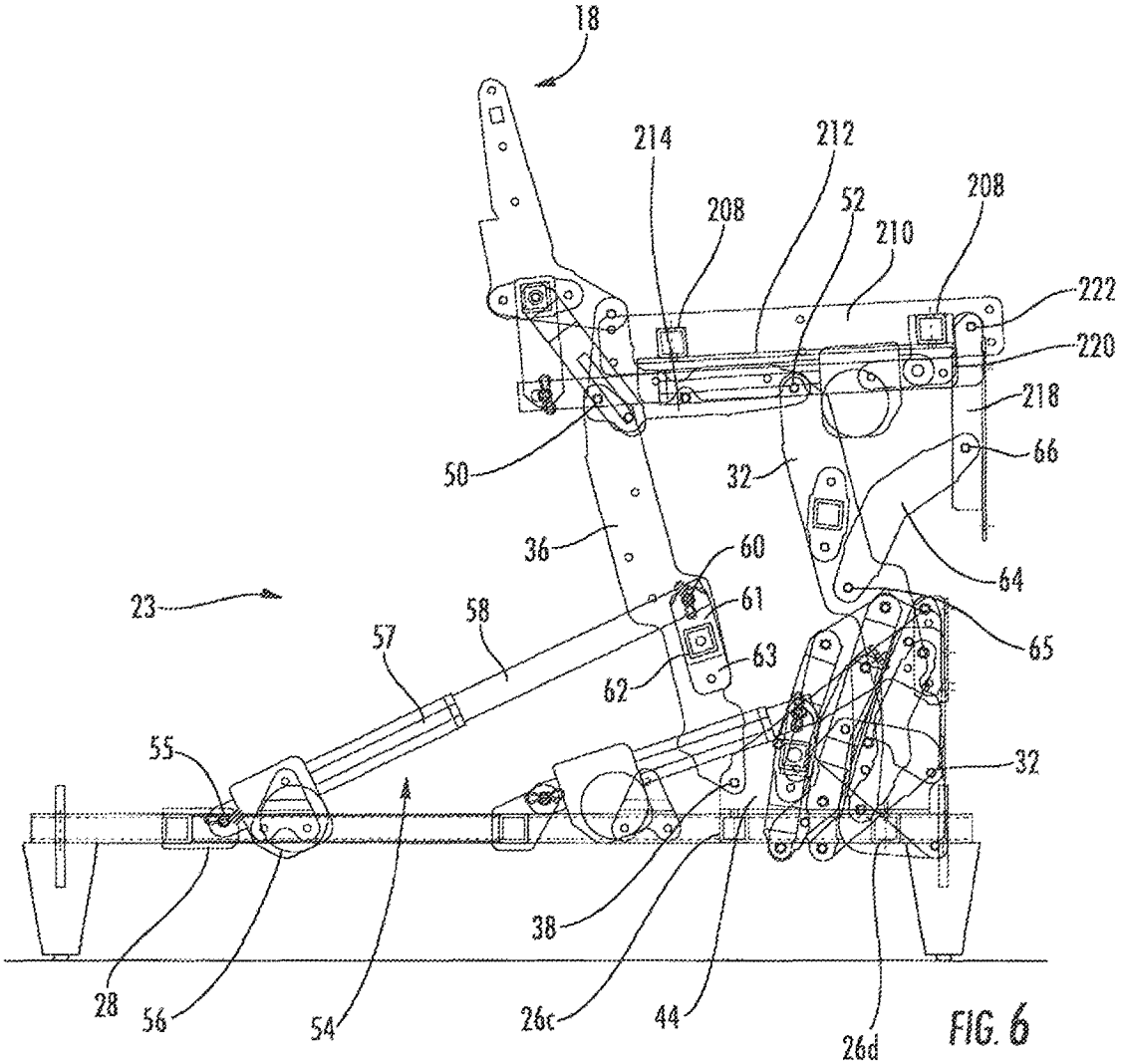
FIG. 6 is a side view of the lift, reclining and footrest mechanisms of the chair of FIG. 1 shown in the lift position.
Figure 9:
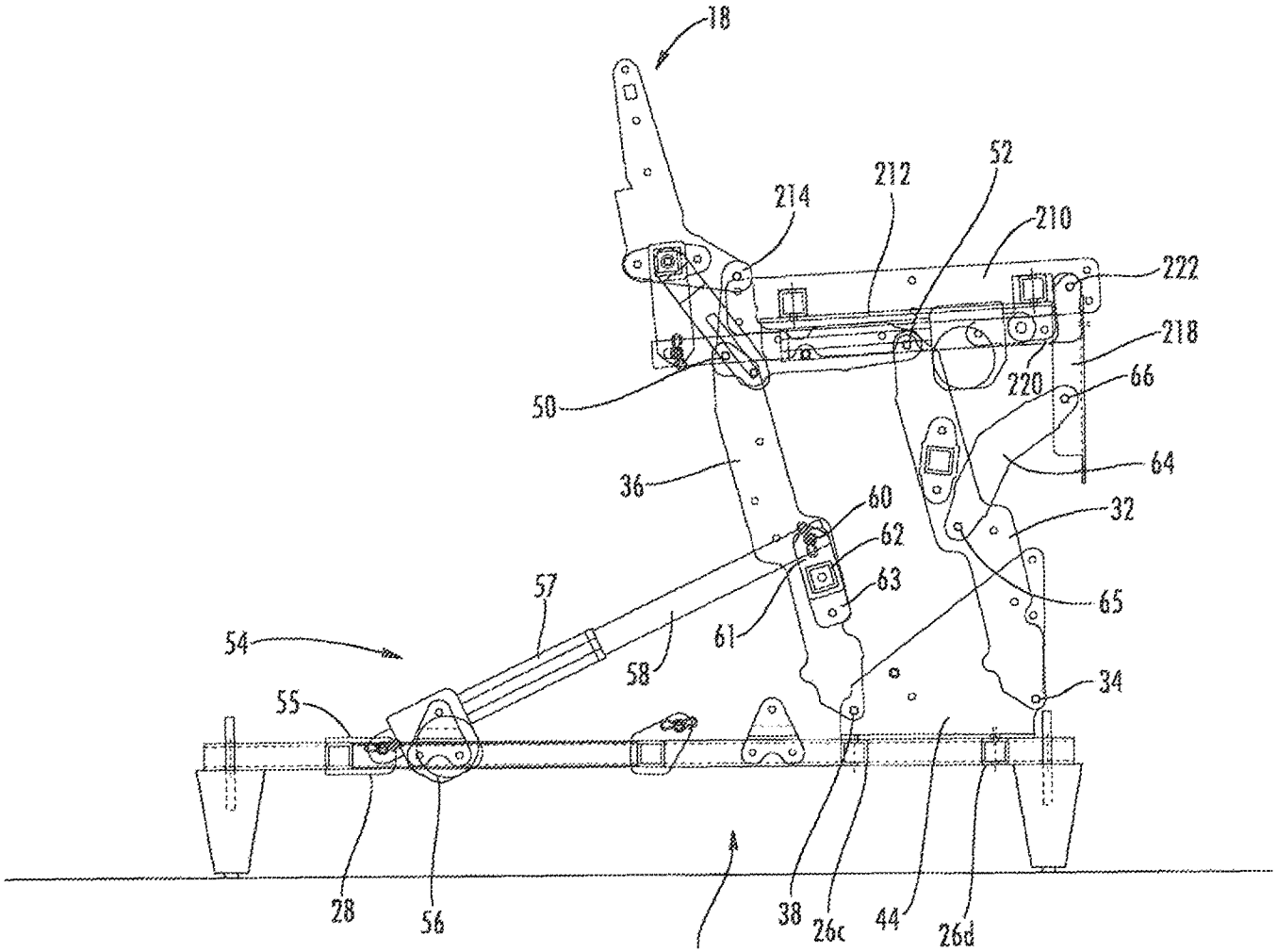
FIG. 9 is a side view of the lift and reclining mechanisms of the chair of FIG. 1 shown in the lift position.

Referring now to FIGS. 6 and 9, the lift mechanism 23 includes a lift mounting plate 44 that is mounted to the upper surface of the cross-member 26*c* and a small member 26*d*. A rear lift link 36 is pivotally mounted to the lift mounting plate 44 at a pivot 38. A front lift link 32 is pivotally mounted to the lift mounting plate 30 at a pivot 34. Each of the front and rear lift links 32, 36 extends upwardly and slightly rearwardly from its respective pivot 34, 38 to a respective pivot 50, 52 with the seat link 214.

A lift actuator 54 is pivotally mounted to the lift actuator mounting bracket 28 at a pivot 55. The actuator 54 includes a motor 56, a sleeve 57 that extends forwardly and upwardly from the motor 56, and a rod 58 that is retractable into and extendable away from the sleeve 57. The forward end of the rod 58 is attached at a pivot 60 to a bracket 61 that is fixed to, a cross-member 62. The cross-member 62 is attached at each end to a bracket 63 fixed to each rear lift link 36. Also, a drawing link 64 is pivotally attached at one end to the front lift link 32 at a pivot 65 and to the angle bracket 218 at a pivot 66.

Figure 5:
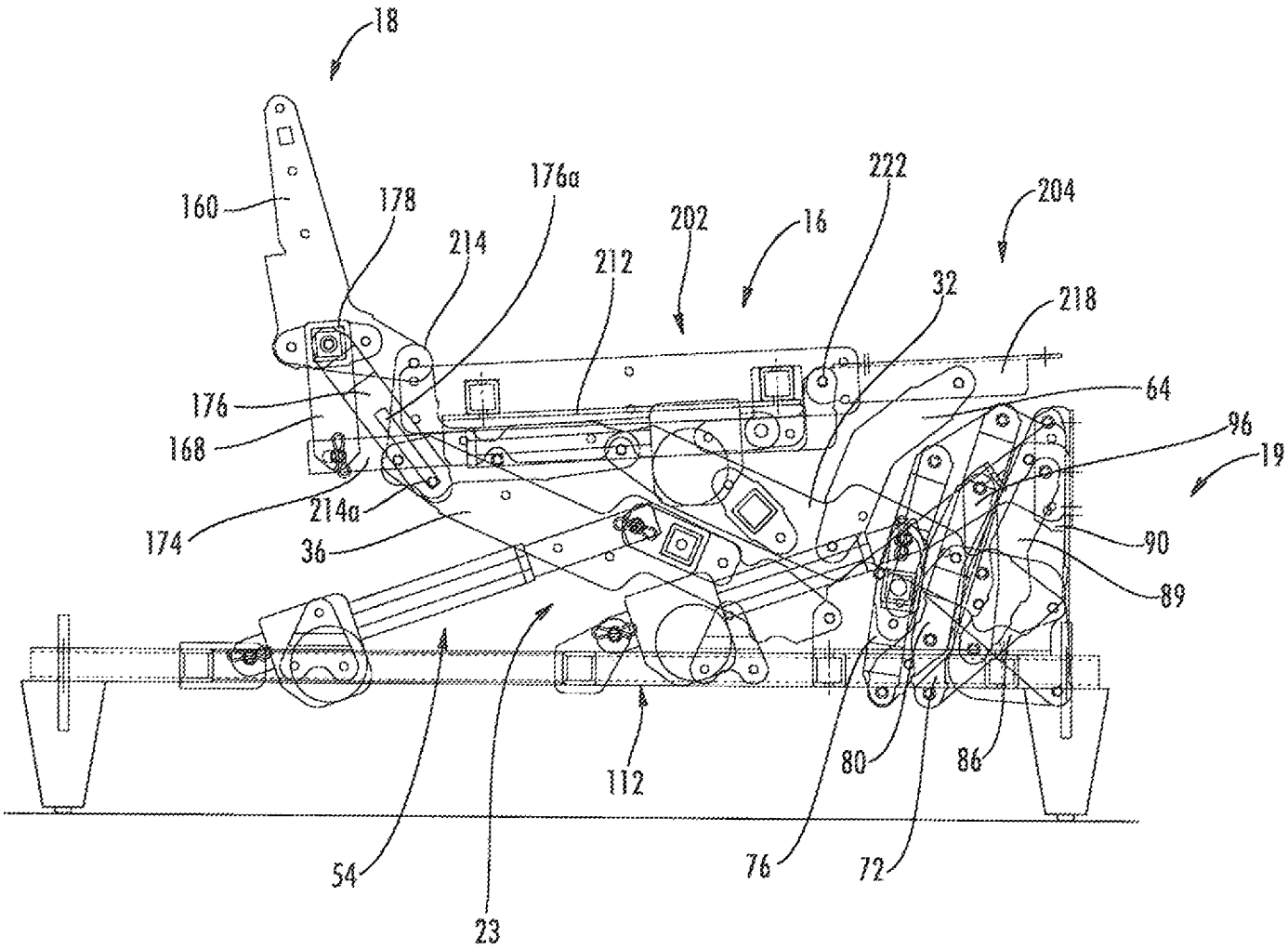
FIG. 5 is a side view of the lift, reclining and footrest mechanisms of the chair of FIG. 1 shown in the upright position.
Figure 8:
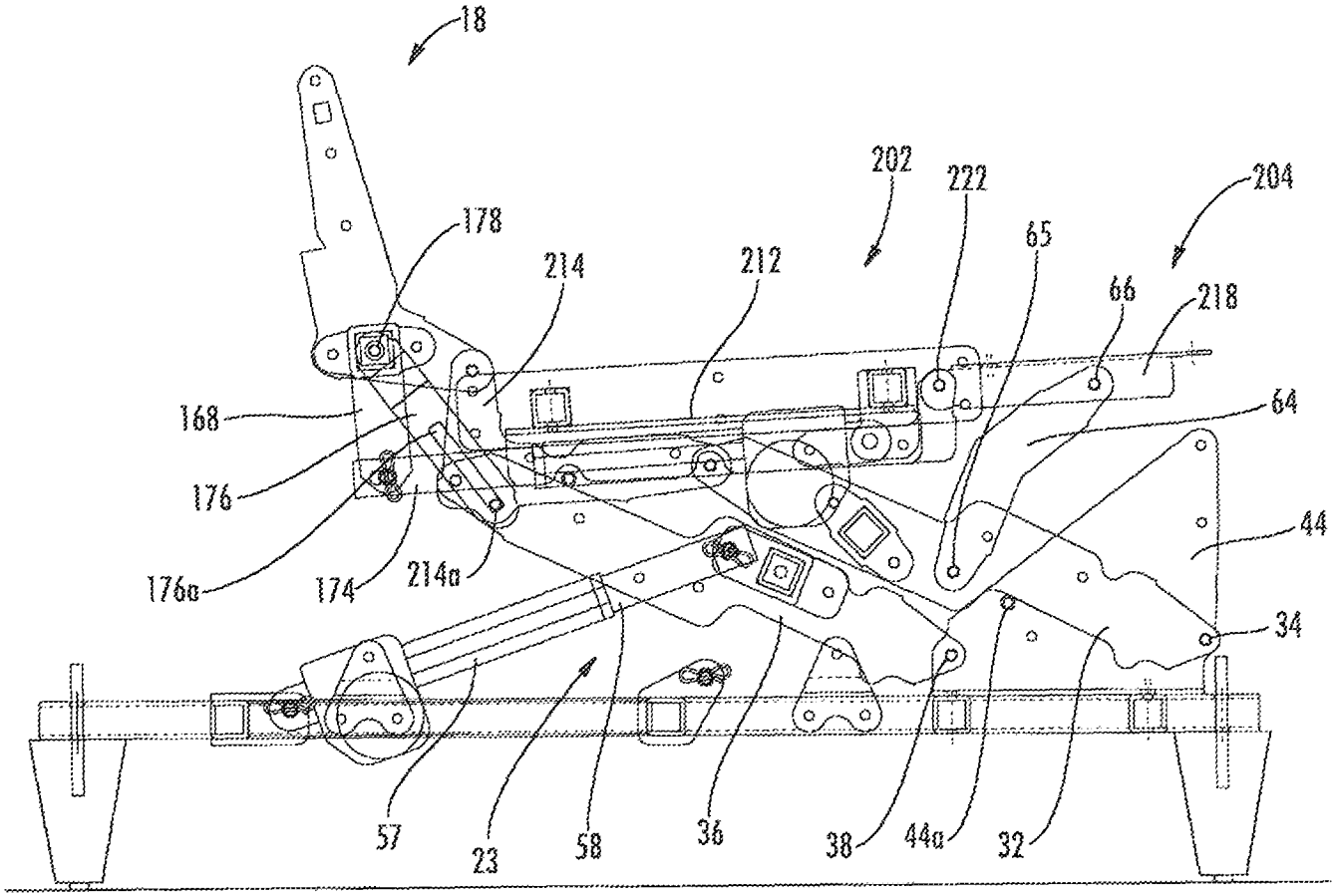
FIG. 8 is a side view of the lift and reclining mechanisms of the chair of FIG. 1 shown in the upright position.

As can be seen in FIGS. 1, 5 and 8, in the upright position the front and rear lift links 32, 36 extend rearwardly from their respective pivots 34, 38 with the lift mounting plate 44. The rod 58 of the lift actuator 54 is retracted into the sleeve 57. The drawing link 64 is extends upwardly and forwardly from the pivot 65 to support the front end of the front portion 204 of the seat 16, such that the front portion 204 is generally horizontal and aligned with the rear portion 202 to form a smooth, horizontally-disposed seating surface. The lift mechanism 23 is maintained in this position by the interaction between a pin 44*a* on the lift mounting plate 44 and the rear edge of the front lift link 32.

To move the chair 10 from the position of FIGS. 1, 5 and 8 to the lift position of FIGS. 2, 6 and 9, an occupant of the chair 10 actuates the lift actuator 54 (typically via a remote control box, console, handheld unit or the like associated with the lift actuator 54). Actuation of the lift actuator 54 extends the rod 58 from the sleeve 57, which forces the rear lift link 36 to pivot clockwise (from the vantage point of FIGS. 1, 5 and 8) about the pivot 38 and cause the seat link 214 (and in turn the rear portion 202 of the seat 16) to rise and move forwardly relative to the base 12. Movement of the seat link 214 causes the front lift link 32 to pivot clockwise about the pivot 34. As the front lift link 32 pivots, the presence of the drawing link 32 draws the angle bracket 218 (and consequently the front portion 204 of the seat 16) clockwise about the pivot 222, thereby rotating the front portion 204 of the seat 16 relative to the rear portion 202 to a generally vertical orientation (see FIGS. 2, 6 and 9). Movement to the lift position ceases when the rod 58 is fully extended.

Notably, the backrest 18 generally maintains its angular orientation relative to the base 12 and to the front portion of the seat 16 as the chair 10 moves to the lift position. The absence of angular movement can prevent the sensation that the chair is "tipping" or "throwing" the occupant from the chair 10 during the lifting movement. Also, the pivoting of the front portion 204 of the seat 16 can facilitate dismounting from the chair 10.

Referring now to the reclining mechanisms 21, each of the reclining mechanisms 21 is a mirror image of the other reclining mechanism about the plane P. In the interest of brevity, only one reclining mechanism 21 will be described herein, with the understanding that the discussion is equally applicable to the other reclining mechanism 21. Also, the reclining mechanism will be described first with respect to the fully reclined position (FIGS. 3, 7 and 10) in order to illustrate more easily the interconnection of the various links thereof.

The reclining mechanism 21 includes an angled backpost 160 that is fixed to the backrest 18. The front end of the backpost 160 is attached to the upper rear end of the seat link 214 at a pivot 162. A bracket 164 is fixed to the lower rear end of the backpost 160; a cross-member 166 extends between the brackets 164 on either side of the chair 10. A backpost extension 168 is fixed to the lower end of the backpost 160 and extends forwardly and downwardly therefrom. Also, a control link 176 with a slot 176*a* is attached to the backpost 160 at a pivot 178 that is substantially collinear with the cross-member 166. A pin 214*a* mounted on the seat link 214 is received, in the slot 176*a*.

A reclining actuator 170 includes a motor 172 and a rod 174 that extends from a sleeve 173. The rod 174 is attached at a pivot 175 to the backpost extension 168. The motor 172 is attached via a pivot 177 to a bracket 179 that is fixed to the forwardmost cross-member 208.

In the upright position of FIGS. 1, 5 and 8, the upper end of the backpost 160 is generally upright, with a slight rearward pitch for comfort. The rod 174 is extended from the sleeve 173. The control link 176 extends downwardly and forwardly from the pivot 178 such that the pin 214*a* on the seat link 214 is positioned in the lower end of the slot 176*a*.

Figure 7:
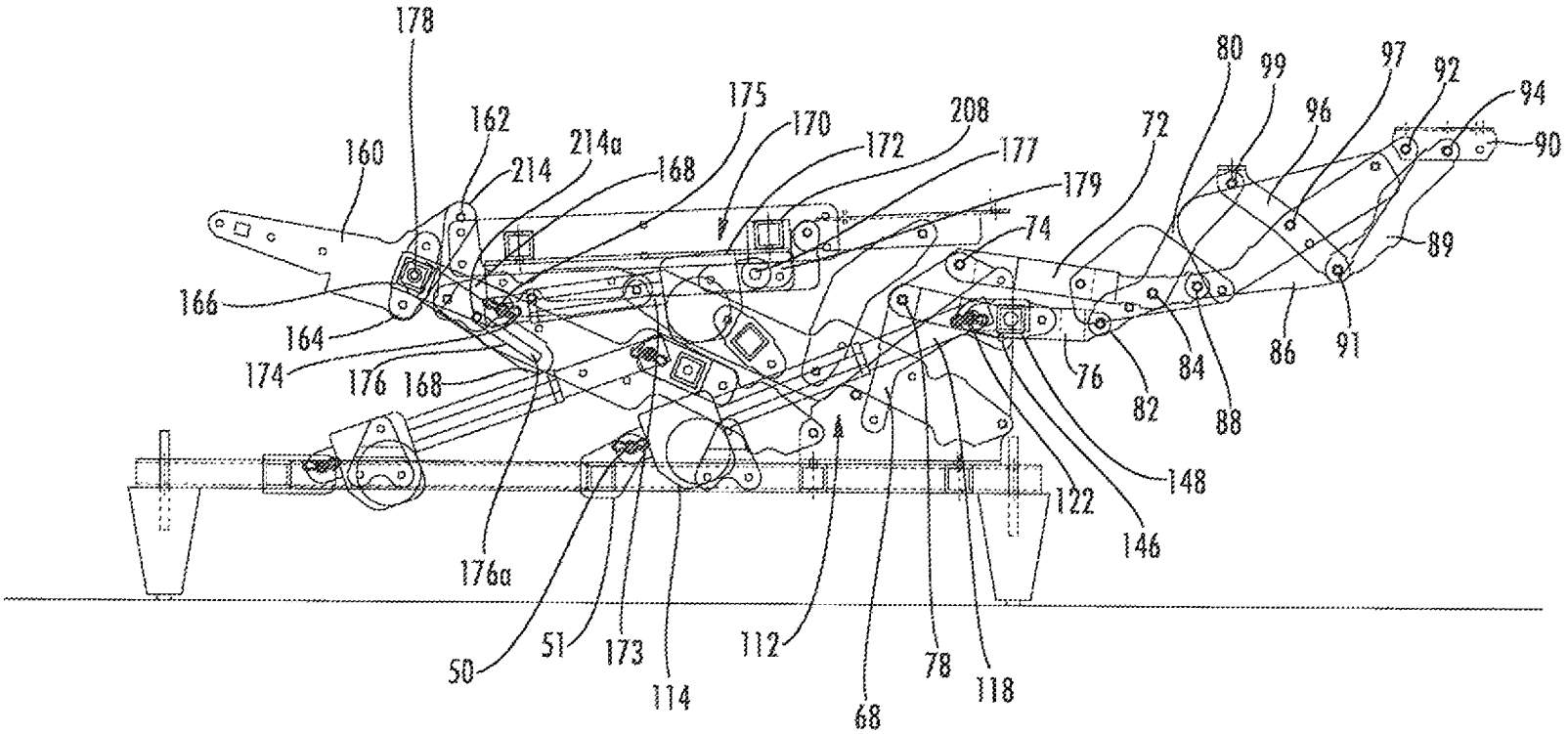
FIG. 7 is a side view of the lift, reclining and footrest mechanisms of the chair of FIG. 1 shown with the backrest in the reclined position and the footrest in the extended position.
Figure 10:
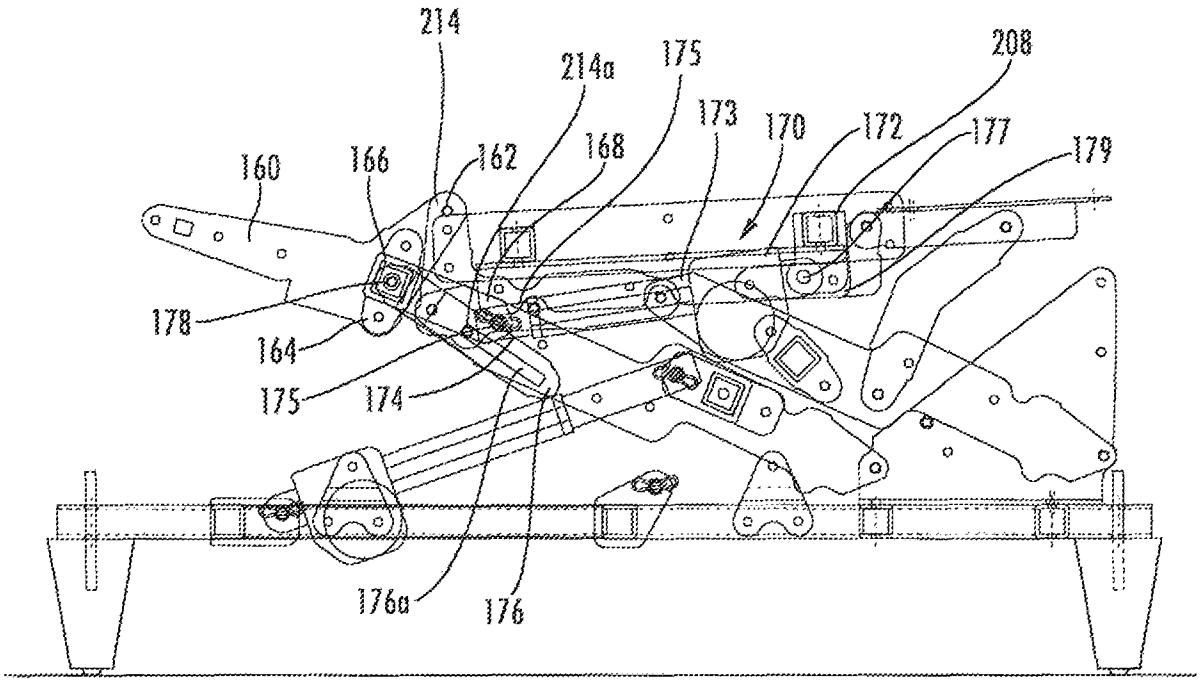
FIG. 10 is a side view of the lift and reclining mechanisms of the chair of FIG. 1 shown with the backrest in the reclined position.

To recline the backrest 18 relative to the seat 16 from the upright position of FIGS. 1, 5 and 8 to the reclined position of FIGS. 3, 7 and 10, the occupant of the chair 10 actuates the reclining actuator 170 (typically via a remote device of the type described above with respect to the lift mechanism 23). The rod 174 retracts into the sleeve 173, thereby drawing the lower end of the backpost extension 168 forward. This motion pivots the backpost 160 counterclockwise about the pivot 162, which reclines the backpost 160 and attached backrest 18 relative to the seat link 214 and attached seat 16. Reclining motion ceases when the control link 176 moves sufficiently forwardly and downwardly that the pin 214*a* strikes the upper end of the slot 176*a*.

Notably, the reclining mechanism 21 is configured to allow the backrest 18 to reclined to a sufficiently shallow angle relative to horizontal (e.g., 0 to 35 degrees) that it can provide a comfortable sleeping position for the occupant. This capability can render the chair 10 particularly suitable for use in health care facilities, retirement facilities, and the like. It should also be noted that the reclining mechanism 21 can take the backrest 18 to any desired angle between the upright position of FIGS. 1, 5 and 8 and the fully reclined position of FIGS. 3, 7 and 10.

Figure 12:
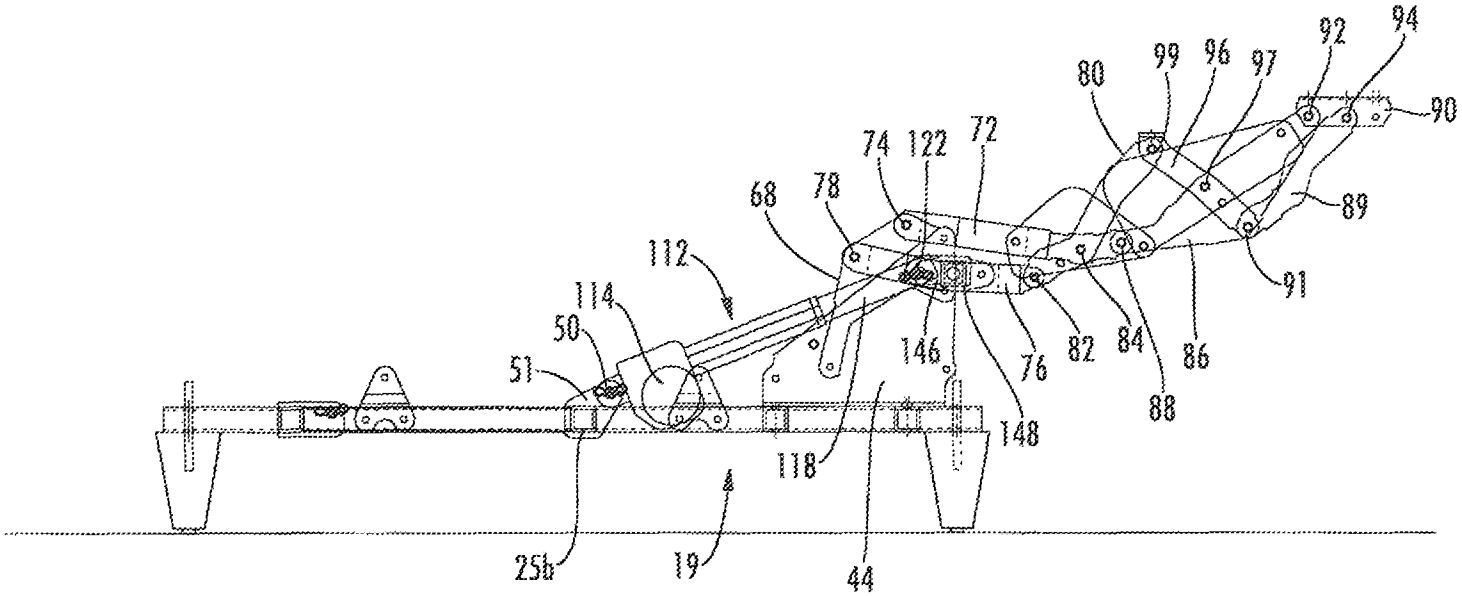
FIG. 12 is a side view of the footrest mechanism of the chair of FIG. 1 shown in its extended position.

Referring now to FIGS. 3, 7 and 12, the footrest mechanisms 19 interconnect the footrests 20*a*, 20*b* with the frame 14 (FIGS. 3, 7 and 12 show the footrests 20*a*, 20*b* in their extended position for clarity of description). Like the lift and reclining mechanisms 23, 21, each of the footrest mechanisms 19 is a mirror image of the other footrest mechanism 19 relative to the vertical plane P. In the interest of brevity, only one footrest mechanism 19 will be described herein, with the understanding that the discussion is equally applicable to its mirror image lift mechanism 23.

As best seen in FIGS. 7 and 12, a footrest adapter 68 is fixed to the lift mounting panel 44. An upper footrest swing link 72 is attached to a front portion of the seat adapter 66 at a pivot 74 and extends downwardly and forwardly therefrom. A lower footrest swing link 76 is attached to the footrest adapter 68 at a pivot 78 that is located rearwardly and downwardly from the pivot 74; the lower footrest swing link 76 extends generally forwardly from the pivot 78. An upper footrest extension link 80 is attached to the forward end of the lower footrest swing link 76 at a pivot 82 and extends forwardly and upwardly therefrom. Also the upper footrest extension link 80 is attached to the upper footrest swing link at a pivot 84. A lower footrest extension link 86 is attached to the forward end of the upper footrest swing link at a pivot 88 that is positioned above and forward of the pivot 84 and extends upwardly and forwardly therefrom generally parallel with the upper footrest extension link 80. A front footrest bracket 90 is generally horizontally disposed and is attached to the lower footrest extension link 86 at a pivot 92. A front footrest stabilizing link 89 is, attached at a pivot 94 to the front footrest bracket 90. The front footrest 20*b* is mounted on the outer footrest bracket 90. A rear footrest bracket 96 is attached at its lower, forward end to the front footrest stabilizing link 89 at a pivot 91, lower footrest extension link 86 at a pivot 98. At its opposite end, the rear footrest bracket 96 supports the front footrest 20*a* and is also attached to the upper footrest extension link 80 at a pivot 99. The rear ottoman bracket 96 is also pivotally attached, to the lower footrest extension link 86 at a pivot 97.

Referring still to FIGS. 3, 7 and 12, the chair 10 includes a linear actuator 112 that drives the rear and front footrests 20*a*, 20*b* between their retracted and extended positions. The actuator 112 includes a motor 114 and a retractable rod 118. The motor 114 is attached at a pivot 50 to the upper end of a tab 50 mounted onto the cross-member 25*b*. The rod 118 of the actuator 112 is attached at a pivot 122 to a projecting bracket 146 that extends from a cross-member 148 between the lower footrest swing links 76.

Figure 11:
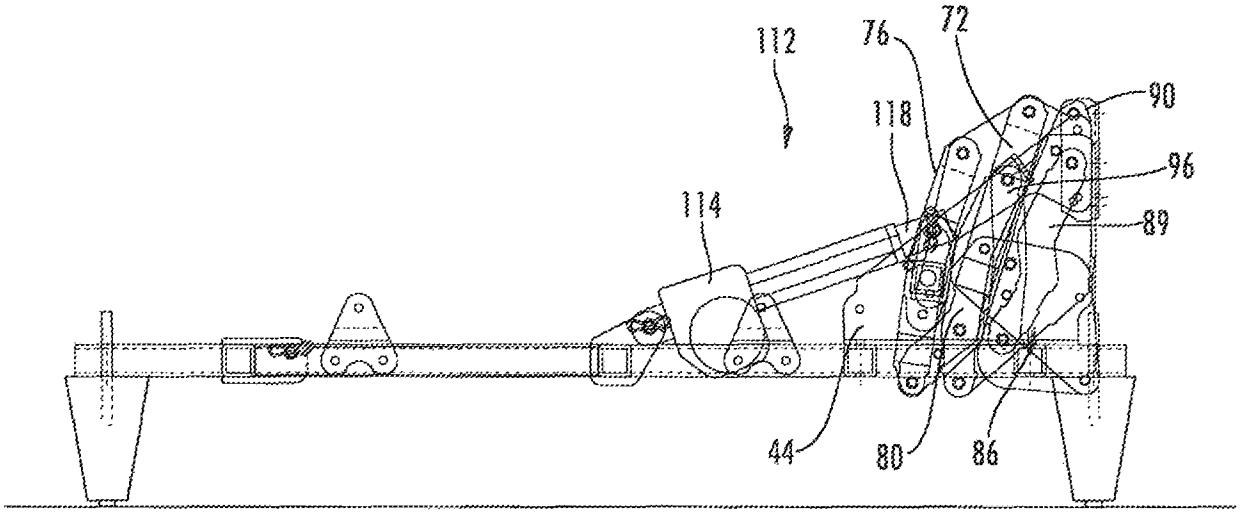
FIG. 11 is a side view of the footrest mechanism of the chair of FIG. 1 shown in its retracted position.

As can be seen in FIGS. 1, 5 and 11, in the retracted position, the rod 118 of the actuator 112 is retracted. Because the rod 118 is in its retracted position, a pantographic linkage formed by the upper and lower footrest swing links 72, 76 and the upper and lower footrest extension links 80, 86 is folded under the seat 14, which positions the footrest 20*a* underneath a forward portion of the seat 16 and the footrest 20*b* just forward of and below the seat 16 in a vertical orientation.

To move the footrests 20*a*, 20*b* from their retracted positions in FIGS. 1, 5 and 11 to their extended positions of FIGS. 3, 7 and 12, an occupant of the chair 10 actuates the actuator 112, which causes the rod 118 to begin to extend away from the motor unit 114, thereby driving the lower footrest swing link 76 counterclockwise about the pivot 78. Rotation of the lower footrest swing link 76 forces the upper footrest extension link 89 forward, which in turn draws the upper footrest swing link 72 counterclockwise around the pivot 74. Also, the lower footrest extension link 86 moves forwardly more than the upper footrest extension link 80, such that the rear footrest bracket 96 rotates counterclockwise about the pivot 97. The rotation of the rear footrest bracket 96 causes the rear footrest 20*a* to rotate from a vertical orientation to a horizontal orientation.

Also, the extension of the lower footrest extension link 86 and the rotation of the rear footrest bracket 96 forces the lower end of the rear footrest bracket 96 forward. This action forces the front footrest stabilizing link 89 forward, which extends and rotates the front footrest bracket 90, and in turn the front footrest 20*b*, to a generally horizontal disposition in front of the seat 16.

All of the lift, reclining and footrest mechanisms are decoupled in the illustrated embodiment and therefore may move independently of each other. It is contemplated that two or three of the lift, reclining and footrest actuators (or drive units other than the illustrated linear actuators) may be actuated from a common device (as an example, a single handheld device with multiple toggle buttons or joysticks to actuate each of the actuators individually). Also, in some embodiments, a cut-off or safety switch or similar actuation blocker may be included to prevent either or both of the reclining mechanism 21 and the footrest mechanism 19 from moving to the reclined or extended positions when the lift mechanism 23 is actuated. Further, such a safety switch may be configured so that the lift mechanism 23 cannot be actuated unless the reclining mechanism 21 is the upright position and the footrest mechanism 19 is in the retracted position (i.e., the chair 10 cannot move to the lift position unless it is in the condition shown in FIG. 1).

It is also noteworthy that, as the seat 16 and backrest 18 move from the upright position to the lift position, the footrest mechanisms 19 and footrests 20*a* remain in the their retracted position on the base 12 and are not lifted. As such, when the seat 16 and backrest are lowered from the lift position to the upright position, the footrests 20*a*, 20*b* are already out of the way and pose no threat to an occupant as he is seating himself with the aid of the lift mechanisms 23.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A seating unit, comprising:

a base configured to rest on an underlying surface;

a frame including opposed arms;

a backrest;

a seat, the seat including a front portion and a rear portion;

a footrest;

a lift mechanism pivotally attached to the base, the frame and the seat;

a lift drive unit attached to the lift mechanism;

a reclining mechanism pivotally attached to the seat and the backrest;

a recline drive unit attached to the reclining mechanism;

a footrest mechanism pivotally attached to the base and the footrest; and a footrest drive unit attached to the footrest mechanism;

wherein the lift mechanism is configured to control the movement of the frame, seat and backrest between an upright position, in which the backrest is generally upright, the front and rear portions of the seat are generally horizontal, the footrest is generally upright and positioned below the seat, and the backrest, seat and frame are at a first elevation, and a lift position, in which the backrest is generally upright, and rear portion of the seat is generally horizontal, and the backrest, rear portion of the seat and frame are at a second elevation that is higher than the first elevation, and the front portion of the seat is generally vertically disposed;

wherein the reclining mechanism is configured to control the movement of the backrest and seat between the upright position and a reclined position, in which the backrest takes a shallower angle relative to horizontal than in the upright position; and wherein the footrest mechanism is configured to control the movement of the footrest between the upright position and an extended position, in which the footrest is generally horizontally disposed and positioned forwardly of the seat.

2. The seating unit defined in claim 1, wherein the footrest mechanism is decoupled from the lift mechanism such that operation of the lift mechanism does not move the footrest relative to the base.

3. The seating unit defined in claim 1, wherein the footrest mechanism is decoupled from the reclining mechanism such that operation of the reclining mechanism does not move the footrest relative to the base.

4. The seating unit defined in claim 1, wherein the lift mechanism is decoupled from the reclining mechanism, such that an angle between the backrest and the underlying surface does not substantially change during operation of the lift mechanism.

5. The seating unit defined in claim 1, wherein the lift, recline and footrest drive units are configured so that the recline and footrest drive units are deactivated during the operation of the lift drive unit.

6. The seating unit defined in claim 1, wherein the lift and recline drive units are configured so that the lift drive unit does not operate unless the reclining mechanism is in the upright position.

7. The seating unit defined in claim 1, wherein the lift and footrest drive units are configured so that the lift drive unit does not operate unless the footrest mechanism is in the upright position.

8. The seating unit defined in claim 1, wherein the reclining mechanism is configured to enable the backrest to take an angle in the fully reclined position that is between about 0 and 35 degrees relative to horizontal.

9. The seating unit defined in claim 1, wherein, the recline drive unit is mounted with the seat, and wherein the recline drive unit moves with the seat when the lift drive unit drives the seating unit between the lift and upright positions.

10. The seating unit defined in claim 1, wherein the lift mechanism and the footrest mechanism are mounted to a common mounting bracket on the base.

11. The seating unit defined in claim 1, wherein the front portion of the seat is pivotally attached to the rear portion of the seat.

12. The seating unit defined in claim 1, wherein the lift mechanism comprises front and rear lift links pivotally attached to the base and the rear portion of the seat, and further comprising a drawing link pivotally attached to the front lift link and the front portion of the seat.

13. A seating unit, comprising:

a base configured to rest on an underlying surface;

a frame including opposed arms;

a backrest;

a seat, the seat including a front portion and a rear portion;

a footrest;

a lift mechanism pivotally attached to the base, the frame and the seat;

a lift drive unit attached to the lift mechanism;

a reclining mechanism pivotally attached to the seat and the backrest;

a recline drive unit attached to the reclining mechanism;

a footrest mechanism pivotally attached to the base and the footrest; and a footrest drive unit attached to the footrest mechanism;

wherein the lift mechanism is configured to control the movement of the frame, seat and backrest between an upright position, in which the backrest is generally upright, the front and rear portions of the seat are generally horizontal, the footrest is generally upright and positioned below the seat, and the backrest, seat and frame are at a first elevation, and a lift position, in which the backrest is generally upright, and rear portion of the seat is generally horizontal, and the backrest, rear portion of the seat and frame are at a second elevation that is higher than the first elevation, and the front portion of the seat is generally vertically disposed;

wherein the reclining mechanism is configured to control the movement of the backrest and seat between the upright position and a reclined position, in which the backrest takes a shallower angle relative to horizontal than in the upright position;

wherein the footrest mechanism is configured to control the movement of the footrest between the upright position and an extended position, in which the footrest is generally horizontally disposed and positioned forwardly of the seat;

wherein the footrest mechanism is decoupled from the lift mechanism such that operation of the lift mechanism does not move the footrest relative to the base; and the footrest mechanism is decoupled from the reclining mechanism such that operation of the reclining mechanism does not move the footrest relative to the base.

14. The seating unit defined in claim 13, wherein the lift mechanism decoupled from the reclining mechanism, such that an angle between the backrest and the underlying surface does not substantially change during operation of the lift mechanism.

15. The seating unit defined in claim 13, wherein the lift, recline and footrest drive units are configured so that the recline and footrest drive units are deactivated during the operation of the lift drive unit.

16. The seating unit defined in claim 13, wherein the lift and recline drive units are configured so that the lift drive unit does not operate unless the reclining mechanism is in the upright position.

17. The seating unit defined in claim 13, wherein the lift and footrest drive units are configured so that the lift drive unit does not operate unless the footrest mechanism is in the upright position.

18. A seating unit, comprising:

a base configured to rest on an underlying surface;

a frame including opposed arms;

a backrest;

a seat, the seat including, a front portion and a rear portion;

a footrest;

a lift mechanism pivotally attached to the base, the frame and the seat;

a lift drive unit attached to the lift mechanism;

a reclining mechanism pivotally attached to the seat and the backrest;

a recline drive unit attached to the reclining mechanism;

a footrest mechanism pivotally attached to the base and the footrest; and a footrest drive unit attached to the footrest mechanism;

wherein the lift mechanism is configured to control the movement of the frame, seat and backrest between an upright position, in which the backrest is generally upright, the front and rear portions of the seat are generally horizontal, the footrest is generally upright and positioned below the seat, and the backrest, seat and frame are at a first elevation, and a lift position, in which the backrest is generally upright, and rear portion of the seat is generally horizontal, and the backrest, rear portion of the seat and frame are at a second elevation that is higher than the first elevation, and the front portion of the seat is generally vertically disposed;

wherein the reclining mechanism is configured to control the movement of the backrest and seat between the upright position and a reclined position, in which the backrest takes a shallower angle relative to horizontal than in the upright position;

wherein the footrest mechanism is configured to control the movement of the footrest between the upright position and an extended position, in which the footrest is generally horizontally disposed and positioned forwardly of the seat;

wherein the lift mechanism is decoupled from the reclining mechanism, such that an angle between the backrest and the underlying surface does not substantially change during operation of the lift mechanism; and wherein the footrest mechanism is decoupled from the lift mechanism such that operation of the lift mechanism does not move the footrest relative to the base.

19. The seating unit defined in claim 18, wherein the lift, recline and footrest drive units are configured so that the recline and footrest drive units are deactivated during the operation of the lift drive unit.

20. The seating unit defined in claim 18, wherein the lift and recline drive units are configured so that the lift drive unit does not operate unless the reclining mechanism is in the upright position.

21. The seating unit defined in claim 18, wherein the lift and footrest drive units are configured so that the lift drive unit does not operate unless the footrest mechanism is in the upright position.

* * * * *